United States Patent [19]

Jenkins

[11] Patent Number: 4,776,510

[45] Date of Patent: Oct. 11, 1988

[54] CONVENTIONAL RETURN ENVELOPE IN A TWO-PART MAILER AND METHOD OF ASSEMBLY

[75] Inventor: Richard A. Jenkins, Wheeling, Ill.

[73] Assignee: Moore Business Forms, Inc., Glenview, Ill.

[21] Appl. No.: 913,248

[22] Filed: Sep. 30, 1986

[51] Int. Cl.[4] ..... B65D 27/06

[52] U.S. Cl. ..... 229/73; 229/69

[58] Field of Search ..... 229/73, 68 R, 69

[56] References Cited

U.S. PATENT DOCUMENTS

| | | | |
|---|---|---|---|
| 3,273,784 | 9/1966 | Porter | 229/69 |
| 3,554,447 | 1/1971 | Sebring | 229/69 |
| 3,726,471 | 4/1973 | Kalb | 229/73 |
| 3,820,447 | 6/1974 | Gendron et al. | 229/73 |
| 3,905,545 | 9/1975 | Juszak et al. | 229/73 |
| 3,912,160 | 10/1975 | Gendron | 229/69 |
| 3,952,942 | 4/1976 | O'Leary et al. | 229/73 |
| 4,091,987 | 5/1978 | Cone | 229/69 |
| 4,157,759 | 6/1979 | Dicker | 206/610 |
| 4,239,114 | 12/1980 | Denay | 229/69 |
| 4,361,269 | 11/1982 | Neubauer | 229/69 |
| 4,461,661 | 7/1984 | Fabel | 229/69 |
| 4,497,509 | 2/1985 | Gore | 229/69 |

FOREIGN PATENT DOCUMENTS 2900226 12/1983 Fed. Rep. of Germany .

*Primary Examiner*—Willis Little

*Attorney, Agent, or Firm*—Cushman, Darby & Cushman

[57] ABSTRACT

A two-part mailer incorporates a conventional return envelope thereinto. The return envelope is affixed to a back side of a first web part that is subsequently heat-sealed to a second web part to form a two-part mailer. The method of assembly has a step in which the return envelope is affixed to the back side of the first web part in such a manner that the return envelope will not interfere with a glassing patch and/or die-cut area in the first web part nor interfere with removal perforations along the web part nor cause excessive bulk in areas where the first web part is heat-sealed to the second web part to form the two-part mailer.

6 Claims, 3 Drawing Sheets

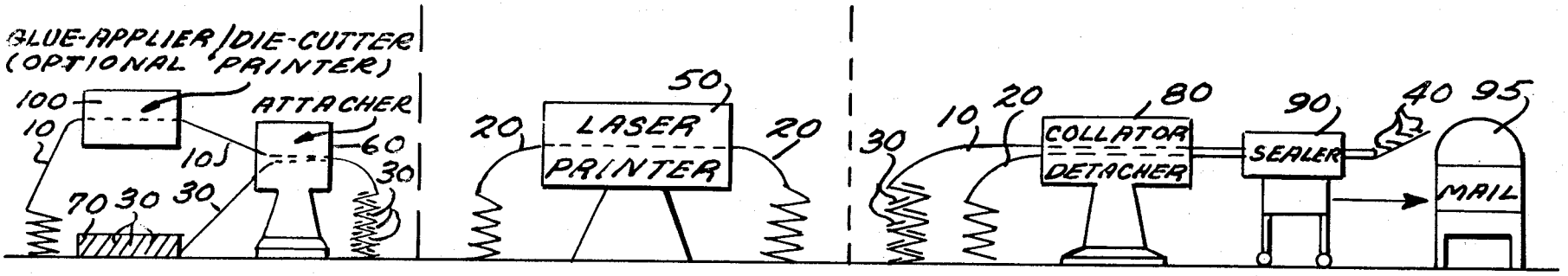
Fig. 1A.
Fig. 1B.
Fig. 1C.
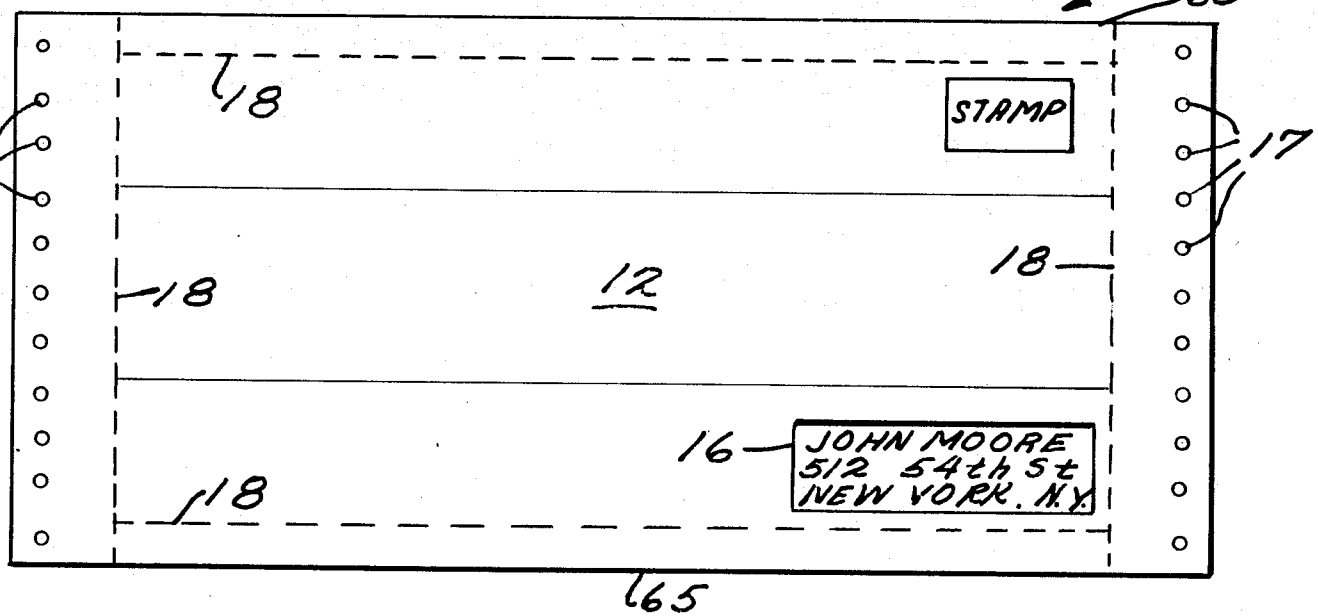
Fig. 2.

CONVENTIONAL RETURN ENVELOPE IN A TWO-PART MAILER AND METHOD OF ASSEMBLY

BACKGROUND OF THE INVENTION

1. Field of the Invention

The present invention relates to a two-part mailer incorporating a conventional return envelope and a method of assembling it.

2. Description of the Related Art

Continuously fed laser printers using heat and pressure to fuse imaged data onto a web part processed through them cannot accept web parts with heat-sensitive glue. However, a mailing product, i.e. a so-called "mailer", can be assembled by manufacturing multiple separate web parts, one of which contains no adhesive or die-cut window/patch, processing this one web through a heat-fusion printer, collating this one web to another web which is manufactured with a heat-sensitive adhesive on all edges and which contains one or more die-cut windows or patches, detaching each web part from a continuous line of web parts which are all joined together lengthwise edge to lengthwise edge, and finally sealing the detached multiple web parts to each other.

This prior art method of assembly is applicable for those mailers not requiring a remittance via a return envelope. However, for a two-way communication requiring the remittance of a payment or the like, it is desirable to incorporate a return envelope into the mailer. Heretofore, a multiple part mailer incorporating a return envelope has not been manufactured using web parts which are processed through continuously fed laser printers because the glue used to create the multi-part mailer melts and also because the bulk of the multi-part mailer with a return envelope incorporated therein has prevented their passage through conventional laser printers.

Consequently, prior art multi-part mailers incorporate return envelopes by being manufactured with at least three and sometimes four parts which are then collated together to form the return envelope inside the mailer. This prior art method of assembly has created several concerns for manufacturers.

First, a separate press run is required to print on one side of the return envelope which is usually made of two web parts itself.

Second, an additional pass through the hot-melt glue applicator is required to apply the adhesive to the return envelope of the multi-part mailer.

Third, a collator pass is required to paste these web parts together so that the return envelope may be secured inside the multi-part mailer.

Fourth, perforations which are required for opening the multi-part mailer must be extremely exact since at least three web parts, before being sealed together, are to be perforated. With a return envelope incorporated between the end web parts, exact alignment of the perforations is extremely difficult to achieve.

Fifth, matching of perforations along all web parts to be joined together is more difficult to achieve whenever the method of assembly is performed at the site of the customer's business because some degree of quality control is lost by the manufacturer of the assembling equipment.

Sixth, opening of the multi-part mailer incorporating a return envelope as two parts thereof is sometimes difficult for the recipient of the mailer if alignment of the perforations between the various web parts has not been accurately made.

Among prior art patents, the affixing of envelopes onto continuous carriers is known for various purposes from Cone, U.S. Pat. No. 4,091,987; Gendron, U.S. Pat. No. 3,912,160; Sebring, U.S. Pat. No. 3,554,447; and Porter, U.S. Pat. No. 3,273,784. It is also known to enclose an envelope in a mailer with the envelope more or less filling the entire outgoing mailer. See Dicker, U.S. Pat. No. 4,157,759. Neubauer teaches in U.S. Pat. No. 4,361,269 that the plies of a Dicker-type mailer may be secured together by hot-melt, pressure-sensitive adhesive. A process for the production of mailable business letters is disclosed by Heinrich in West German Pat. No. 29 00 226 in which two webs are shown, one carrying a glue pattern.

However, none of these references solve all of the problems either existing in conventional mailers with envelopes inside or known to exist in prior art methods of assembling mailers having usually four web parts.

SUMMARY OF THE INVENTION

A two-part mailer has a first web part which serves as a cover and second web part which serves as a backing. The first web part usually does not have any image printed on it. However, a conventional return envelope is affixed to the back side of the first web part. This back side is inside the assembled two-part mailer. The second web part has an image printed on its front side which is also inside the assembled two-part mailer. The image printed on the front side of the second web part includes an address which faces through a glassine patch or die-cut area on the first web part.

The steps of the assembling method which also is included within the scope of the present invention include the following: first, adding hot-melt glue to all edges on the back side, die-cutting and/or patching one or two windows, and perforating lines necessary for opening the non-imaged first web part; second, affixing a conventional return envelope to the back side of the first web part so that the return envelope will not interfere with the glassine patch/die-cut area nor interfere with removal perforations nor cause excessive bulk; third, printing the image on the second web part; and fourth, heat-sealing the first web part to the second web part to form the two-part mailer with the conventional return envelope incorporated therein.

Preferably, the first and second steps are carried out by the manufacturer of the two web parts and the return envelope while the third and fourth steps are carried out on the site of the mailer's business.

There are several advantages of the present invention over the prior art. Less press, make-ready, and run time are required. Less web parts are needed. Accurate registration of perforations on only two web parts, instead of three or four, is required. At least one collator pass is eliminated. The use of cold-melt rewettable glue and its resultant drying time delays are eliminated.

Other advantages occur for the mailer. For example, the return envelope can be made by the manufacturer according to the mailer's own design and system requirements as to ink colors, paper colors, return address required, etc. Alternatively the return envelope may be a conventional stationery item. The present invention also allows the use of a return envelope incorporating a clear glassine window, thus enabling a remittance statement to be inserted in such a manner that the information necessary for sending back the return envelope appears in the clear glassine window.

As for the end recipient, there are also certain advantages when the present invention is used. Opening of the mailer is easy because there are only two web parts which are perforated for tearing so that the contents of the mailer may be examined. Opening of the mailer is facilitated since perforation match and alignment of the two web parts are not critical. Also, a conventional familiar return envelope may be provided to facilitate usage through easy removal of the envelope from the mailer, insertion of the remittance into the return envelope, and sealing of the return envelope with the remittance inside.

These and other advantages of the present invention will be more fully understood from the following description of the drawings and the preferred embodiment.

BRIEF DESCRIPTION OF THE DRAWINGS

FIGS. 1A through 1C show the apparatuses for carrying out the steps of the method of the present invention.

FIG. 2 shows a front side of a first web part which serves as a cover for the two-part mailer.

DETAILED DESCRIPTION OF THE PREFERRED EMBODIMENT

Figure 3:
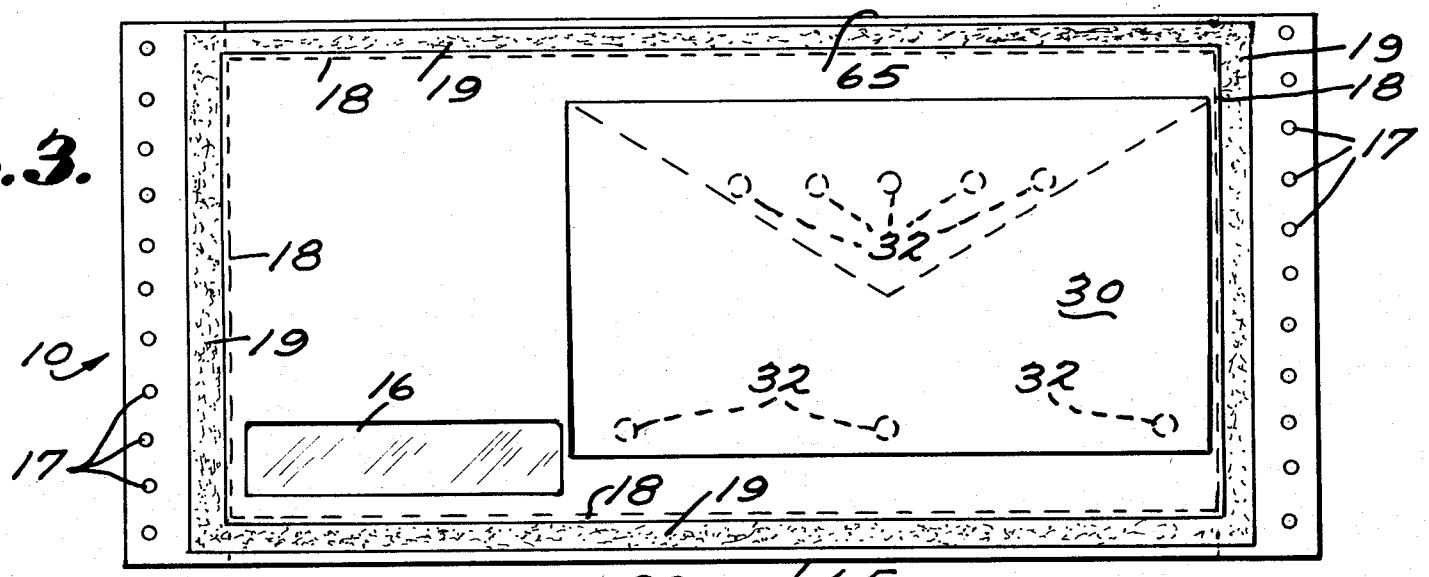
FIG. 3 shows a return envelope affixed to a back side of the first web part shown in FIG. 2.

Steps carried out at a manufacturing site are schematically represented in FIG. 1A which shows a first web part 10 having affixed thereto a return envelope 30 by an attacher 60. In FIG. 1B, a second web part 20 is shown being imaged by a press printer 50, such as a laser printer, on the site of the mailer's business. Also, at the mailer's business, as shown in FIG. 1C, the first web part 10 carrying the return envelope 30 is sealed to a second web part 20 by a sealer 90 to form a two-part mailer 40 having the return envelope 30 contained inside. Details of the steps of the method of the present invention will be described later.

The first web part 10 has a front face 12 shown in FIG. 2 and a back side 14 shown in FIG. 3. With reference to FIG. 2, it may be seen that a clear glassine window 16 may be patched or die-cut in a lower corner area of the first web part 10. Perforations 18 are provided along all marginal edges of the first web part 10.

Referring to FIG. 3, it may be seen that, on the back side 14 of the first web part 10, glue areas 19 are also provided on all marginal edges so that such glue areas 19 are removed whenever the perforations 18 are torn. The return envelope 30 is also affixed by glue spots 32 to the back side 14 of the first web part 10 in such a manner that the return envelope 30 does not interfere with the glassine window 16 in the die-cut area nor interfere with the perforations 18. The return envelope 30 is conventional and is not so bulky as to interfere with the sealing of the glue areas 19 of the first web part 10 to the second web part 20.

Figure 4:
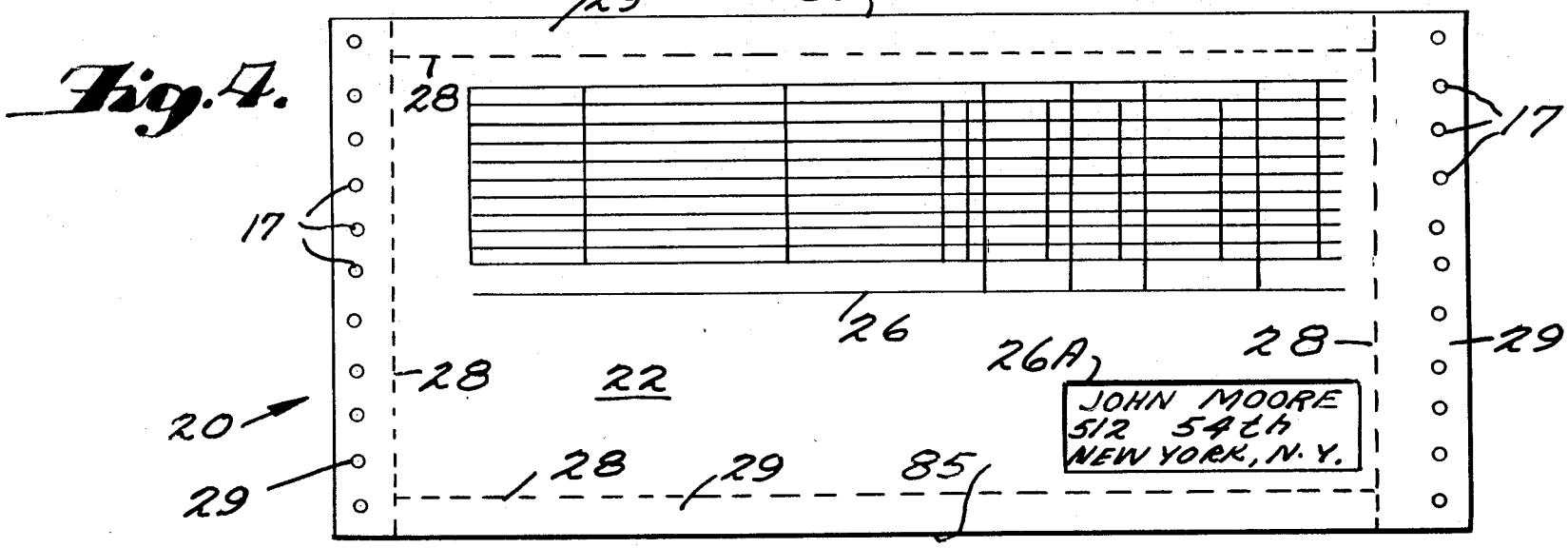
FIG. 4 shows a printed front side of a second web part which serves as a backing for the two-part mailer.
Figure 5:
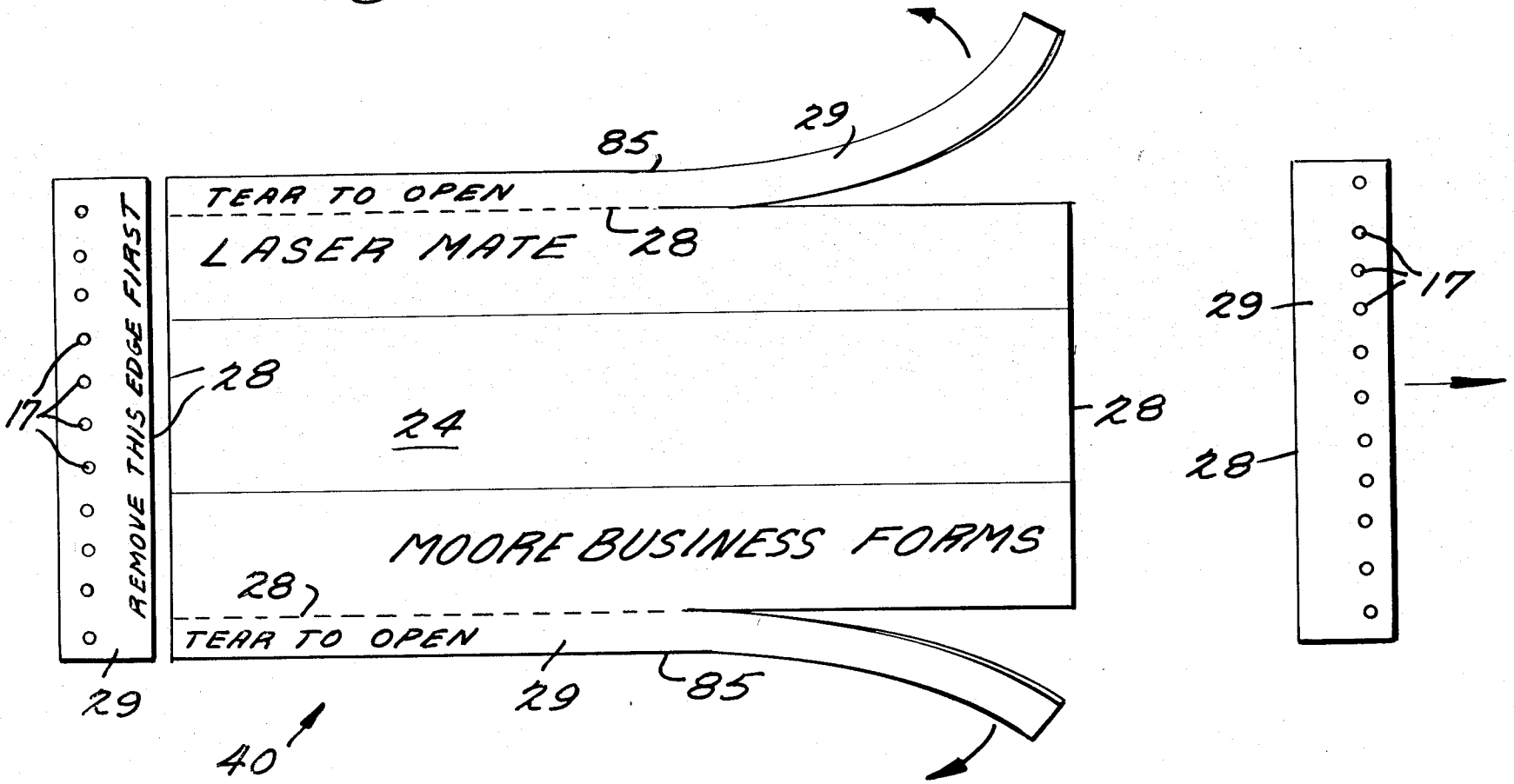
FIG. 5 shows a back side of the second web part, shown in FIG. 4, with the two-part mailer in the process of being opened by the end recipient.

The second web part 20 has a front side 22 shown in FIG. 4 and a back side 24 shown in FIG. 5. With reference to FIG. 4, it may be seen that an image 26 may be printed by a laser method or otherwise onto the front side 22 which faces the back side 14 of the first web part 10. An address portion 26A of the image 26 is printed so that it is aligned with and shows through the clear glassine window 16 of the facing back side 14 of the first web part 10. The remainder of the image 26 may be information in the nature of a statement or the like calling for the sending of a remittance in the return envelope 30. Perforations 28 are provided along all marginal edges 29 of the second web part 20. These perforations 28 on the second web part 20 are aligned with the perforations 18 on the first web part 10.

The end recipient opens the two-part mailer 40 in the manner shown in FIG. 5 by tearing all perforations 28 to remove the marginal edges 29 from the second web part 20 of FIG. 4. Since the second web part 20 is secured to the first web part 10 by glue areas 19 shown in FIG. 3, such tearing of the perforations 28 will simultaneously tear all perforations 18 along the marginal edges of the first web part 10. Consequently, the end recipient will be left with the statement image 26 on the front side 22 of the second web part 20, as shown in FIG. 4, and the return envelope 30 affixed to the back side 14 of the first web part 10, as shown in FIG. 3. After the return envelope 30 is pulled away from the back side 14 of the first web part 10, the end recipient may fold the statement on the front side 22 of the second web part 20 and place such statement in the return envelope 30 with a payment or other remittance.

The apparatus and method of assembling the two-part mailer 40 with the return envelope 30 inside will now be described by returning to FIGS. 1A through 1C.

Referring first to FIG. 1A, it may be seen that there is a long continuous line of paper having a plurality of the first web parts 10 joined together. This long continuous line of first web parts 10 is initially fed into a glue-applier/die cutter 100 which adds glue areas 19 to the backside 14 of each first web part 10, as shown in FIG. 3, and then die-cuts a lower corner area of each of the plurality of first web parts 10, as shown in both FIGS. 2 and 3. Optionally, a clear glassine window 16 may be patched into each of the first web parts 10 to obtain the completed first web part 10 shown in FIGS. 2 and 3. Thereafter, the long continuous line of first web parts 10 is fed to an attacher 60 which also simultaneously receives a plurality of return envelopes 30 fed from an envelope feeder 70. This operation on the long continuous line of first web parts 10 is carried out at the manufacturer's plant.

Optionally, a return address and an advertisement may also be conventionally printed on the front side of each of the first web parts 10 before the glue areas 19 are applied to the backside 14 of each such first web part 10.

Turning now to FIG. 1B, a press printer 50, such as the laser printer, receives at one end a long continuous line of second web parts 20 upon which the image 26 is printed on the front side 22 of each of the second web parts 20 so that the end result is the second web part 20 as shown in FIG. 4. Preferably, this step is carried out at the site of the mailer's business.

Referring now to FIG. 1C, each of the first web parts 10 with the return envelopes 30 affixed thereto is fed into a collator/detacher 80 to interface with each of the second web parts 20. Punched holes 17, as shown in FIGS. 2–5, help guide and align each of the first web parts 10 and second web parts 20 through the collator/-detacher 80. After being collated, each first web part 10 and each second web part 20 are detached from their long continuous lines by the collator/detacher 80 and fed to a sealer 90. The first web part 10 with the return envelope 30 affixed thereto is heated along its glue areas 19 (FIG. 3) by the sealer 90 so that the second web part 20 is joined thereto to form the two-part mailer 40 with the return envelope 30 inside. All mailers 40 so formed are then sent by mail 94 in bulk to the end recipients whose addresses are printed on the address portion 26A (FIG. 4) that shows through the window 16 (FIG. 2).

The foregoing preferred embodiment is considered illustrative only. Numerous other modifications and changes will readily occur to those persons skilled in the paper manifolding art after reading the disclosure.

For example, the printer 50 is not limited to a continuously fed heat-fusion laser printer but may include a conventional impact printer, either line or serial. Also, the printer 50 is not limited to a heat-fusion type but may include a cold-fusion type.

Furthermore, the second web part 20 may include more than one-ply with a back ply to be decollated prior to introduction and collation with the first web part 10 containing the affixed return envelope 30. All plies of the second web part 20 may be glued together as a set which, after being printed, is collated to the first web part 10.

However, the disclosed invention is not limited to the exact construction and operation shown and described hereinabove but rather is embraced within the scope of the appended claims.

What is claimed is:

1. A two-part, return envelope-bearing mailer stock, comprising:

a first generally rectangular web part having an outer face, an inner face and detachable edge marginal strip means extending about four edges, which include two longitudinally-extending opposite end edges and two transversally-extending opposite side edges thereof;

said marginal edge strip means bearing strip means of hot melt glue extending about said four edges, on said inner face;

a longitudinally-extending series of punched web guide holes provided on said marginal strip means on each of said opposite end edges;

a window aperture formed through said first web part in a main portion thereof defined more centrally of said first web part than said marginal edge strip means;

a generally rectangular return envelope having front and rear plies joined about three edges to define a pocket, and a glue-bearing flap foldably joined to one of said plies along a fourth edge of such ply, for folding over a corresponding fourth edge of the other of said plies and gluing to said other ply for closing said pocket;

said return envelope being arranged with one said ply thereof in facewise confronting relationship with said inner face of said first web part with said return envelope being arranged so as to avoid obscuring said window aperture;

means detachably securing said return envelope so arranged in said facewise confronting relationship;

a second generally rectangular web part having an outer face, an inner face and detachable edge marginal strip means extending about four edges, which include two longitudinally-extending opposite end edges and two transversally-extending opposite side edges thereof;

said second generally rectangular web part being of a size sufficiently corresponding to that of said first generally rectangular web part that said marginal edge strip means of said first and second generally rectangular web parts may be placed in inner face to inner face facewise confrontation fully perimetrically of said main portion of said first generally rectangular web part;

a longitudinally-extending series of punched web guide holes provided on said marginal strip means on each of said opposite end edges of said second generally rectangular web part, the longitudinally-extending series of punched web guide holes provided on said marginal strip means on each of said opposite end edges of said second generally rectangular web parts being arranged to register hole-for-hole with respective ones of said longitudinally-extending series of punched web guide holes provided on said marginal strip means on each of said opposite end edges of said first generally rectangular web part when said first and second generally rectangular web parts are placed in inner face to inner face facewise confrontation fully perimetrically of said main portion of said first generally rectangular web part;

means defining a region on said inner face of said second generally rectangular web part positioned to be registered with said window aperture for visibility therethrough when said first and second generally rectangular web parts are placed in inner face to inner face facewise confrontation fully perimetrically of said main portion of said first generally rectangular web part with respective ones of said longitudinally-extending series of punched web guide holes disposed in hole-for-hole registration web to web, for reception of a variably-printed initial send-to name and address; and said second generally rectangular web part being substantially free of hot melt adhesive such as would be, if present, subject to activation by use of a heat-to-fuse-toner-type of non-impact printer for variably printing an initial send-to name and address in said region on said inner face of said second generally rectangular web part.

2. The two-part mailer stock of claim 1, wherein:

said means detachably securing said return envelope comprise at least one glue spot removably gluing an outer face of a said ply of said return envelope directly to said inner face of said first generally rectangular web part in said main portion of said first generally rectangular web part.

3. A two-part, return envelope-bearing mailer, comprising:

a first generally rectangular web part having an outer face, an inner face and detachable edge marginal strip means extending about four edges, which include two longitudinally-extending opposite end edges and two transversally-extending opposite side edges thereof;

said marginal edge strip means bearing strip means of hot melt glue extending about said four edges, on said inner face;

a longitudinally-extending series of punched web guide holes provided on said marginal strip means on each of said opposite end edges;

a window aperture formed through said first web part in a main portion thereof defined more centrally of said first web part than said marginal edge strip means;

a generally rectangular return envelope having front and rear plies joined about three edges to define a pocket, and a glue-bearing flap foldably joined to one of said plies along a fourth edge of such ply, for folding over a corresponding fourth edge of the other of said plies and gluing to said other ply for closing said pocket;

said return envelope being arranged with one said ply thereof in facewise confronting relationship with said inner face of said first web part with said return envelope being arranged so as to avoid obscuring said window aperture;

means detachably securing said return envelope so arranged in said facewise confronting relationship;

a second generally rectangular web part having an outer face, an inner face and detachable edge marginal strip means extending about four edges, which include two longitudinally-extending opposite end edges and two transversally-extending opposite side edges thereof;

said second generally rectangular web part being of a size sufficiently corresponding to that of said first generally rectangular web part that said marginal edge strip means of said first and second generally rectangular web parts may be placed in inner face to inner face facewise confrontation fully perimetrically of said main portion of said first generally rectangular web part;

a longitudinally-extending series of punched web guide holes provided on said marginal strip means on each of said opposite end edges of said second generally rectangular web part, the longitudinally-extending series of punched web guide holes provided on said marginal strip means on each of said opposite end edges of said second generally rectangular web parts being arranged to register hole-for-hole with respective ones of said longitudinally-extending series of punched web guide holes provided on said marginal strip means on each of said opposite end edges of said first generally rectangular web part when said first and second generally rectangular web parts are placed in inner face to inner face facewise confrontation fully perimetrically of said main portion of said first generally rectangular web part;

means defining a region on said inner face of said second generally rectangular web part positioned to be registered with said window aperture for visibility therethrough when said first and second generally rectangular web parts are placed in inner face to inner face facewise confrontation fully perimetrically of said main portion of said first generally rectangular web part with respective ones of said longitudinally-extending series of punched web guide holes disposed in hole-for-hole registration web to web, for reception of a variably-printed initial send-to name and address;

said region on said inner face of said second generally rectangular web part having variably printed thereon an initial send-to name and address using heat-fused toner;

said first and second generally rectangular web parts being disposed in inner face to inner face facewise confrontation fully perimetrically of said main portion of said first generally rectangular web part with respective ones of said longitudinally-extending series of punched web guide holes disposed in hole-for-hole registration web to web, said hot melt glue on said marginal edge strip means of said first generally rectangular web part fully perimetrically sealing said first and second web parts together.

4. The two-part, return envelope-bearing mailer of claim 3, wherein:

said means detachably securing said return envelope comprise at least one glue spot removably gluing an outer face of a said ply of said return envelope directly to said inner face of said first generally rectangular web part in said main portion of said first generally rectangular web part.

5. A process for preparing a two-part, return envelope-bearing mailer, comprising:

(a) providing as a first part:

a first generally rectangular web part having an outer face, an inner face and detachable edge marginal strip means extending about four edges, which include two longitudinally-extending opposite end edges and two transversally-extending opposite side edges thereof;

said marginal edge strip means bearing strip means of hot melt glue extending about said four edges, on said inner face;

a longitudinally-extending series of punched web guide holes provided on said marginal strip means on each of said opposite end edges;

a window aperture formed through said first web part in a main portion thereof defined more centrally of said first web part than said marginal edge strip means;

a generally rectangular return envelope having front and rear plies joined about three edges to define a pocket, and a glue-bearing flap foldably joined to one of said plies along a fourth edge of such ply, for folding over a corresponding fourth edge of the other of said plies and gluing to said other ply for closing said pocket;

said return envelope being arranged with one said ply thereof in facewise confronting relationship with said inner face of said first web part with said return envelope being arranged so as to avoid obscuring said window aperture;

means detachably securing said return envelope so arranged in said facewise confronting relationship;

(b) providing as a second part:

a second generally rectangular web part having an outer face, an inner face and detachable edge marginal strip means extending about four edges, which include two longitudinally-extending opposite end edges and two transversally-extending opposite side edges thereof;

said second generally rectangular web part being of a size sufficiently corresponding to that of said first generally rectangular web part that said marginal edge strip means of said first and second generally rectangular web parts may be placed in inner face to inner face facewise confrontation fully perimetrically of said main portion of said first generally rectangular web part;

a longitudinally-extending series of punched web guide holes provided on said marginal strip means on each of said opposite end edges of said second generally rectangular web part, the longitudinally-extending series of punched web guide holes provided on said marginal strip means on each of said opposite end edges of said second generally rectangular web parts being arranged to register hole-for-hole with respective ones of said longitudinally-extending series of punched web guide holes provided on said marginal strip means on each of said opposite end edges of said first generally rectangular web part when said first and second generally rectangular web parts are placed in inner face to inner face facewise confrontation fully perimetrically of said main portion of said first generally rectangular web part;

means defining a region on said inner face of said second generally rectangular web part positioned to be registered with said window aperture for visibility therethrough when said first and second generally rectangular web parts are placed in inner face to inner face facewise confrontation fully perimetrically of said main portion of said first generally rectangular web part with respective ones of said longitudinally-extending series of punched web guide holes disposed in hole-for-hole registration web to web, for reception of a variably-printed initial send-to name and address; and said second generally rectangular web part being substantially free of hot melt adhesive such as would be, if present, subject to activation by use of a heat-to-fuse-toner-type of non-impact printer for variably printing an initial send-to name and address in said region on said inner face of said second generally rectangular web part;

(c) variably printing an initial send-to name and address in said region on said inner face of said second generally rectangular web part using a heat-to-fuse toner-type of non-impact printer;

(d) placing said first and second generally rectangular web parts in inner face to inner face facewise confrontation fully perimetrically of said main portion of said first generally rectangular web part with respective ones of said longitudinally-extending series of punched web guide holes disposed in hole-for-hole registration web to web, with said return envelope sandwiched between said first and second generally rectangular web parts and said initial send-to name and address exposed through said window aperture; and (e) passing said first and second web parts and sandwiched return envelope while so-placed, between heated platens for activating said hot melt glue on said marginal edge strip means of said first generally rectangular web part, thereby fully perimetrically sealing said first and second web parts together.

6. The process of claim 5, wherein:

said means detachably securing said return envelope comprise at least one glue spot removably gluing an outer face of a said ply of said return envelope directly to said inner face of said first generally rectangular web part in said main portion of said first generally rectangular web part.

* * * * *